United States Patent [19]

Ring et al.

[11] 3,995,973

[45] Dec. 7, 1976

[54] VARIABLE DISPLACEMENT HYDRAULIC SYSTEM

[75] Inventors: Curtis Phillip Ring; Raymond John Hemming, both of Cedar Falls, Iowa

[73] Assignee: Deere & Company, Moline, Ill.

[22] Filed: Sept. 4, 1975

[21] Appl. No.: 610,234

[52] U.S. Cl. ..... 417/214; 417/252; 417/270; 417/295; 60/444

[51] Int. Cl.[2] ..... F04B 1/04; F04B 49/00

[58] Field of Search ..... 60/444; 417/212, 214, 417/251, 270, 295, 252

[56] References Cited

UNITED STATES PATENTS

| | | | |
|---|---|---|---|
| 3,002,462 | 10/1961 | Raymond | 417/214 |
| 3,306,211 | 2/1967 | Kunzler | 417/295 |
| 3,738,111 | 6/1973 | Fletcher | 417/270 |
| 3,815,478 | 6/1974 | Axelsson | 91/497 |

*Primary Examiner*—Carlton R. Croyle
*Assistant Examiner*—G. P. LaPointe

[57] ABSTRACT

A variable displacement hydraulic system includes a charge system having a substantially constant charge pressure, a reciprocating piston type pump having a drive chamber in communication with the charge system, and a control valve regulating the flow of fluid from the charge system to the inlet of the reciprocating piston type pump which is manually movable from a closed fluid blocking position through a first range in which it varies and controls the quantity of fluid flowing to the pump inlet and a second range in which it varies the control of pressure of fluid flowing to the pump inlet at flow rates greater than those obtainable in the first range.

18 Claims, 2 Drawing Figures

VARIABLE DISPLACEMENT HYDRAULIC SYSTEM

BACKGROUND OF THE INVENTION

The present invention relates generally to the art of hydraulics and more specifically relates to a system for varying the displacement of reciprocating piston type pumps.

In the past there have been many proposals for varying the displacement of reciprocating piston type pumps. These include both manual systems for varying the displacement at the will of an operator and automatic systems for varying the displacement to obtain substantially constant pressure. The proposals have included varying the eccentricity of a cam or other piston reaction member, varying the angular relationship of a swash plate or equivalent piston reaction member with respect to the pistons, controlling the quantity of fluid flowing to the pistons on their intake stroke, and controlling intake stroke length by maintaining either a constant inlet pressure or a constant drive chamber pressure and varying the drive chamber pressure or the inlet pressure respectively.

Each of the previous proposals has its advantages and disadvantages and in many cases the proposal used depended not only on the particular application but also on personal preference. Proposals for varying the eccentricity of a cam or the angularity of a swash plate have the disadvantage of being somewhat complicated, but have the advantage of providing accurate displacement control. These last-mentioned proposals were also speed sensitive. That is, the pump flow or output would vary with the speed at which the pump was driven. Depending on the application, this was either an advantage or disadvantage.

The previous proposals for varying displacement by controlling the quantity of fluid flowing to the pistons on their intake stroke have the advantage of being relatively simple, but for some applications have the disadvantage of not being speed sensitive.

Previous proposals for varying displacement by maintaining either a constant inlet pressure or a constant drive chamber pressure and varying the drive chamber pressure or inlet pressure, respectively, have the advantage of relative simplicity, but, in those applications requiring speed sensitity, it was extremely difficult to obtain accurate control of displacement over the entire range of displacement.

SUMMARY OF THE INVENTION

The object of the present invention is to provide a system for varying the displacement of the pump which is simple in construction and provides for accurate control throughout the range of displacement of the pump and in which the flow of the pump varies according to the speed of the prime mover for the pump.

According to the invention, variable displacement of a reciprocating piston pump is obtained by varying the stroke length of the pistons, and the stroke length of the pistons is controlled by maintaining a substantially constant pressure within the drive chamber for the pistons and controlling the quantity of fluid delivered to the pistons during periods of low displacement and controlling the pressure of fluid delivered to the pistons during periods of high displacement. During periods of high displacement when the pressure of the fluid delivered to the pistons is controlled, the flow of the pump will be sensitive to pump speed so that when the pump is used as part of a hydrostatic transmission an increase in prime mover or engine speed will drive the pump at a higher speed to thereby increase the flow of the pump in terms of quantity per unit time and result in increased vehicle speed. During periods of low displacement when the quantity of fluid flowing to the pistons is controlled the pump is not sensitive to prime mover speed, but direct control of the quantity of fluid flowing to the pistons provides a more accurate control than does control of the pressure of the fluid delivered to the pistons and the necessity of accurate control at low displacement is much greater than the desirability of having pump flow vary with engine speed.

The foregoing, along with additional objects and advantages of the present invention will become apparent to those skilled in the art from a reading of the following detailed description when taken in conjunction with the accompanying drawings.

DESCRIPTION OF THE PREFERRED EMBODIMENT

Figure 1:
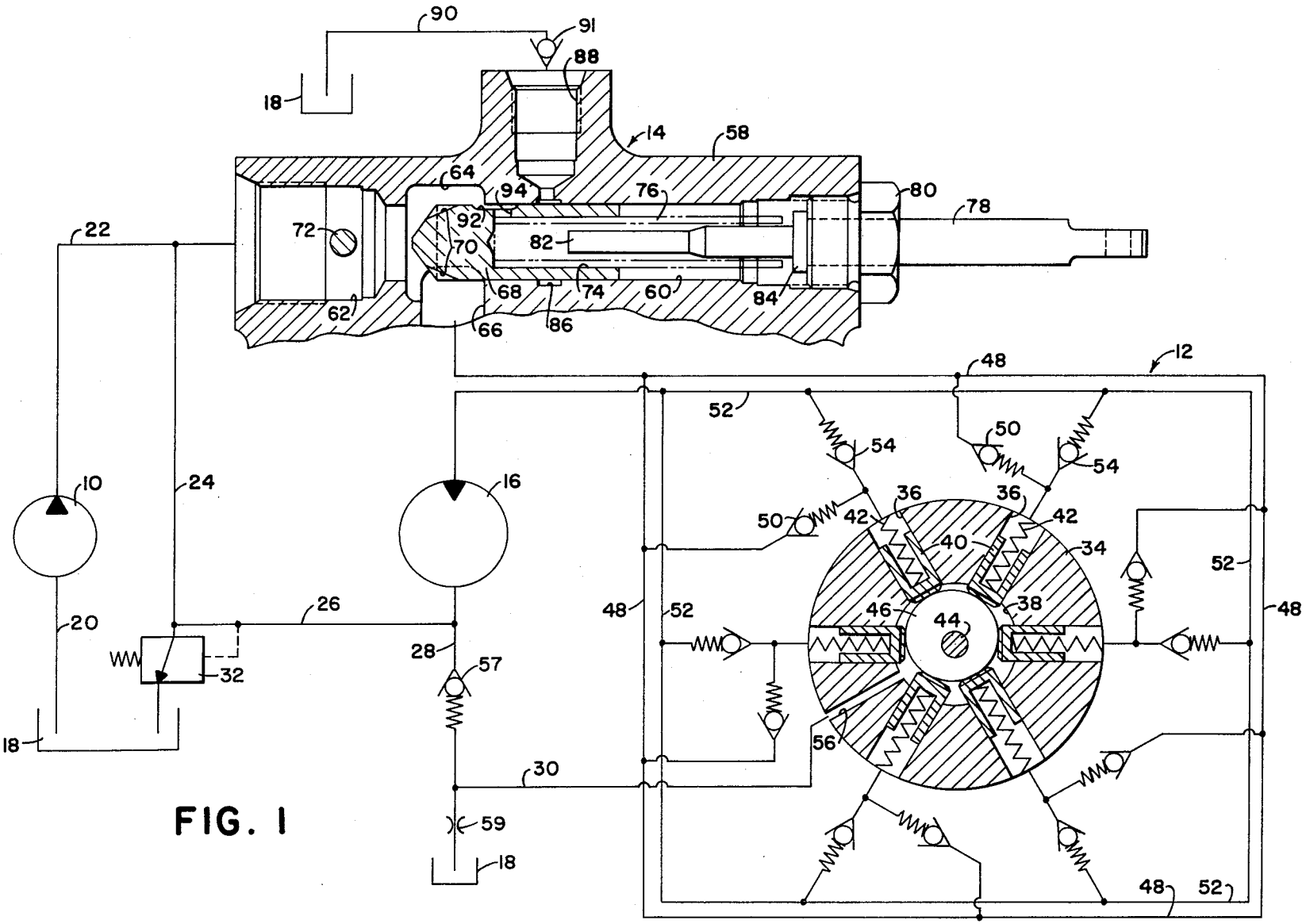
FIG. 1 is a partially schematic and partially sectional view of a hydrostatic transmission embodying the present invention.

Referring now to the drawings, a preferred embodiment of the invention is, for purposes of illustration, embodied in a hydrostatic transmission which includes a charge pump 10, a main pump indicated generally at 12, a control valve indicated generally at 14 and a hydraulic motor 16. The charge pump 10 draws fluid from a reservoir 18 through a fluid line 20 and delivers the fluid to a charge system made up of fluid lines 22, 24, 26, 28, and 30. A relief type pressure regulating valve 32 is interposed in the fluid line 24 and limits the maximum pressure in the charge system. By limiting the maximum pressure in the charge system, the relief valve 32 maintains a substantially constant pressure in the charge system.

The main pump 12 includes a cylinder barrel 34 provided with a plurality of cylinders 36 which open into a drive chamber 38. A piston 40 is reciprocally mounted in each of the cylinders 36 and has one end projecting through the open end of its respective cylinder into the drive chamber 38. A spring 42 is mounted in each cylinder and acts against one end of the cylinder and the respective piston to normally force the piston inwardly toward the drive chamber. A drive shaft 44 which is adapted to be driven by an external prime mover such as an internal combustion engine is journaled in the cylinder body 34 and extends through the drive chamber 38. A circular drive cam 46 is eccentrically mounted on and secured to the drive shaft 44 for rotation therewith so that upon rotation of the drive shaft the cam 46 will rotate and engage the pistons 40 to force the same outwardly through a discharge stroke.

Each of the cylinders 36 is connected to the pump inlet represented by the fluid line 48 through a check valve 50 and to the pump outlet represented by the fluid line 52 through a check valve 54. The drive chamber 38 of the pump 12 is also in communication with the fluid line 30 of the charge circuit through a passage 56. A spring loaded check valve 57 is interposed in the fluid line 28, and the fluid line 28 is also connected, downstream of the check valve 57, to the reservoir 18 through a restriction 59. The check valve 57 and restriction 59 provide a pressure differential between the fluid in the lines 28 and 30 so that the fluid pressure in the drive chamber 38 is less than the pressure in the charge circuit by a predetermined amount. The fluid pressure within the drive chamber 38 and the springs 42 are matched so that the forces exerted on each of the pistons are substantially balanced when the piston is at the outer end of its movement and the spring is compressed.

It should be noted that while the pump 12 is illustrated as a radial piston pump, this is only for purposes of illustration since other reciprocating piston type pumps such as an axial piston pump would be equally suitable.

The inlet 48 of the pump 12 is connected to the fluid line 22 of the charge system through the control valve 14 and the outlet 52 of the pump 12 is connected to the inlet of the motor 16. The outlet of the motor 16 is connected to the fluid line 28 of the charge system so that pressurized fluid discharged from the main pump 12 drives the motor 16 and is returned to the charge circuit.

The control valve 14 includes a valve body 58 having a valve bore 60 extending therethrough. One end of the valve bore 60 is enlarged as at 62 and forms a first port or inlet port which is connected to the fluid line 22 of the charge system. Intermediate its ends and removed from the enlarged area 62 of the valve bore 60 is provided with a groove or second enlarged area 64 which is in communication with a second port or outlet port 66 which is connected to the main pump inlet 48. A piston type valving element 68 is slidably mounted in the valve bore 60 for movement between the extreme fluid passing position illustrated in FIG. 1 in which it permits free fluid flow between the valve inlet and outlet ports and the extreme fluid blocking position illustrated in FIG. 2 in which it provides communication between the valve inlet and outlet ports.

The end of the valving piston 68 which faces the inlet port or the head is provided with a pair of metering notches 70 which provide accuracy in flow control when the valve 14 is initially opened. When the valving piston 68 is in its extreme closed position as determined by engagement between the head end of the valving piston 68 and a pin 72, metering notches 70 which are always open to the inlet port are closed from the outlet port 66. The head end of the valving piston 68 and the inlet end of the valve bore form, as can best be understood by referring to FIG. 2, an expansible pressure chamber which is responsive to pressure in the charge circuit and inlet port to bias the valving spool toward its open position.

The end of the valving piston 68 remote from its head end is provided with a blind bore 74 and a compression spring 76 has one end seated within the blind bore. A plunger member 78 is slidably and sealingly mounted within an end cap 80 for the valve bore 60 and has one end 82 extending through the compression spring 76 into the blind bore 74. An annular flange 84 on the plunger member 78 forms a shoulder for engagement with the compression spring 76. The length of the spring 76 is chosen such that it will not be compressed between the inner end of the blind bore 74 and the shoulder formed by the flange 84 when the plunger 78 is withdrawn to the extent permitted by the flange 84 and the valving piston 68 is in its extreme open position. The strength of the spring 76 is chosen such that the force exerted by the spring when it is compressed to the extent necessary for the inner end of the plunger 82 to abut against the inner end of the blind bore 74 is less than the force exerted on valving piston 68 by fluid pressure within the inlet port.

Figure 2:
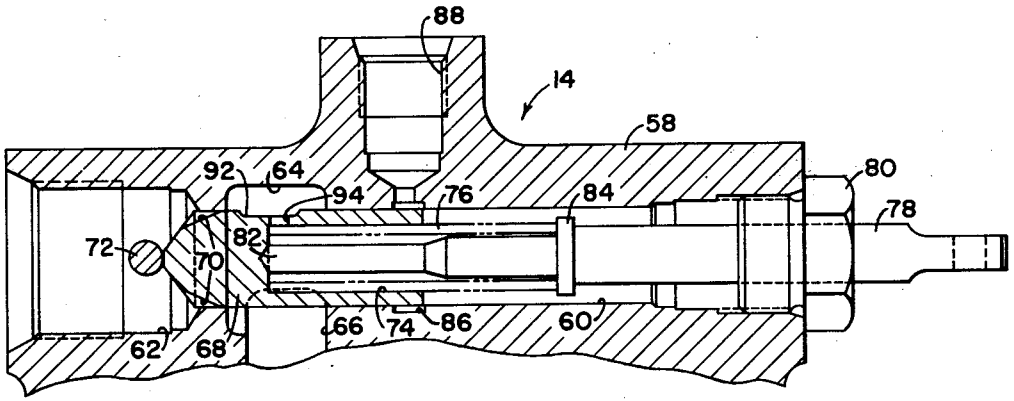
FIG. 2 is a sectional view of a portion of the transmission illustrated in FIG. 1 illustrating alternate positions of the components.

A groove 86 is provided in the valve bore 60 in a position spaced from the groove 64 and is located so that it is closed by the valving piston 68 whenever the valving piston is moved from its extreme closed position as is illustrated in FIG. 1 and is open to the valve bore 60 whenever the valving piston 68 is in its extreme closed position as is illustrated in FIG. 2. The groove 86 is in communication with an additional valve port 88 which is connected to the reservoir 18 through a check valve 91 and a fluid line 90. The valving piston 68 is also provided with a recessed area 92 which is in constant communication with the bore groove 64, and a transverse opening 94 in the valving piston 68 provides communication between the recessed area 92 and the inner end of the blind bore 74. With this construction the valve outlet port 66 is in constant communication with the valve bore 60 on the back side of the valving piston 68 or the end of the valving piston 68 remote from the head end. Also, when the valving piston 68 is in its fully closed position the outlet port 66 is in communication with the reservoir 18 through the additional port 88, check valve 91 and fluid line 90.

The back side of the valving piston 68 and the valve bore 60 form a second servo means or expandable pressure chamber which is responsive to fluid pressure within the outlet port 66 to bias the valving piston 68 toward its extreme closed position.

The above described transmission system operates as follows. Assuming the valve 14 is closed as illustrated in FIG. 2, and that the pumps 10 and 12 are being driven, the charge pump 10 in combination with the relief valve 32 maintain a substantially constant pressure within the charge circuit with all fluid provided by the pump 10 in excess of that needed for make up of leakage exhausted through the valve 32 to the reservoir 18. The main pump 12 will also be in a standby condition since the charge pressure within the drive chamber 38 will normally hold the pistons 40 away from the drive cam 46. This is possible since the force of the springs 42 is no greater than the force created by charge pressure against the inner ends of the pistons and there is no fluid pressure in the inlet 48 of the main pump due to the inlet 48 being connected to the reservoir 18 through the valve outlet port 66, the recess 92 in valving piston 68, the transverse opening 94 in valving piston 68, the blind bores 74 in valving piston 68, the groove 86, the port 88, check valve 89 and fluid line 90. Check valve 91 allows oil to flow to reservoir but not from, thus not allowing the pump to flow when valve is blocked. It should also be noted from FIG. 2 that when the control valve 14 is in its extreme closed position the head end of the valving piston 68 is held against the pin 72 by direct contact between the inner end 82 of the plunger 78 and the inner end of the blind bore 74. Thus the spring 76 is compressed to its maximum but is still exerting a force on the valving piston 68 less than the force exerted on the valving piston 68 by fluid pressure within the first servo means or expandable pressure chamber.

The main pump 12 can be brought into stroke to supply fluid under pressure to motor 16 by manual movement of the plunger 78 to the right as viewed in the drawings. As the plunger 78 is moved to the right, fluid pressure acting on the head end of the valving piston 68 moves the valving piston with the plunger so that the metering grooves 70 begin to provide communication between the inlet port 62 and the bore groove 64. Fluid passing through the metering grooves 70 to the groove 64 is routed directly to the cylinders 36 through the valve outlet port 66 and pump inlet port 48, and this fluid forces the pistons 40 inwardly to partially fill the cylinders 36. As the cam 46 rotates it drives the pistons 40 outwardly forcing fluid from the cylinder 36 to the motor 16 by way of the main pump outlet 52. The fluid passing through the motor 16 is returned to the charge circuit so that the charge pump 10 only has to provide sufficient fluid to make up for any leakage within the system and for any fluid which passes to the reservoir 18 by way of the valve 32, the restriction 59 or the valve groove 86 and valve port 88. It should be noted that as the valving piston 68 followed the plunger 78 to the left, communication between the valve bore 60 and groove 86 was cut off. Also, it should be noted that the same fluid pressure delivered to the cylinders 36 was routed to the second servo means or expandable pressure chamber by way of the recess 92, transverse opening 94 and blind bore 74. However, due to the pressure drop across the metering grooves 70 the force exerted by the fluid pressure in the second servo means plus the force of the spring 76 is still less than the force exerted on the head end of the valving piston 68 by fluid pressure within the first servo means so that the valving piston 68 is still under direct control of the plunger 78 due to engagement therebetween. Thus, manual movement of the plunger 78 at this point is controlling the amount of fluid flowing to the main pump 12 and hence the amount of fluid delivered to the motor 16.

As the plunger 78 is moved further to the right, the metering grooves 70 are opened wider permitting increased fluid flow to the main pump 12. The increased flow through the valve 14 results in a decrease in the pressure drop between the enlarged area 62 of the bore 60 and groove 64. Since the pressure in the charge circuit and hence in the enlarged area 62 of the bore 60 or the first servo means is maintained substantially constant, the decrease in pressure drop across the valve 14 results in an increase in pressure in the valve outlet port 66 and in the second servo means.

When the pressure within the second servo means has reached a point where the force exerted by the fluid pressure within the second servo means on the valving piston 68 plus the force exerted by the spring 76 on the valving piston 68 equals the force exerted by the fluid pressure in the first servo means, additional movement of the plunger 78 to the right will cause the inner end 82 of the plunger to move out of engagement with the valving piston 68 and the valve 14 begins to control the pressure rather than the quantity of the fluid flowing to the main pump 12. Additional movement of the plunger 78 to the right increases the pressure of the fluid delivered to the main pump 12 since this movement permits extension of a compression spring 76 which results in a decrease in the force exerted by the spring. As the force exerted by the spring decreases, fluid pressure within the first servo means moves the valve towards it fully open position until the fluid pressure within the second servo means increases by amount sufficient to exert an additional force equal to the force removed from the spring.

It should be noted that when the valve 14 is controlling the amount of fluid flowing to the main pump 12 the flow rates are in the very low range and each of the pistons 40 of the main pump is moved inwardly by only a small amount so there is relatively little change in the force exerted by the pistons 40 by the springs 42. However, as the valve 14 moves into a pressure controlled condition, the flow rates are greater and the springs 42 acting on the pistons 40 are relaxed to an extent that the force exerted thereby decreases by a considerable amount. Thus, the displacement of the main pump 12 is varied by varying the pressure of the fluid delivered to the intake of the main pump 12. That is, the force exerted on the pistons 40 by the springs 42 plus the force due to pressure in the main pump inlet will always substantially equal the force due to pressure within the drive chamber 38 so an increase in the pressure of a fluid delivered to the main pump 12 will result in increased movement of the piston 40 so that the force exerted by the spring 42 is decreased. This results in increased displacement per revolution of the main pump 12 and an increase in delivery of fluid from the motors 16.

The above described control system provides good control of motor speed at all times. Specifically, engagement between the inner end 82 of the plunger 78 and the inner end of the blind bore 74 provides positive shutoff of the valve 14. When low speed of the motor 16 is required, the flow control characteristic of the valve 14 provides an operator with an accurate control over the amount of fluid delivered to the main pump 12 and hence to the motor 16 and the amount of fluid delivered is not dependent upon the speed of the prime mover drive in the main pump 12. That is, no matter how fast the main pump 12 is driven the amount of fluid delivered to the main pump is controlled so that the output of the main pump is completely dependent upon the amount of fluid passing through the valve 14. Further, when it is desired to drive the motor 16 at high speeds the valve 14 is in a pressure controlled condition so that the output of the pump 12 and speed of the motor 16 will be sensitive to the speed of the prime mover driving the pump 12. That is, the valve 14 does not control the amount of fluid delivered to the pump 12 but only controls the pressure of the fluid delivered thereto so that if the pressure delivered to the main pump 12 is maintained constant the flow thereof will vary with the speed of its prime mover. This is an extremely desireable characteristic of the system when used as the drive system of a motor vehicle.

Having thus described the preferred embodiment of the invention various modifications within the spirit and scope of the invention will become apparent to those skilled in the art and can be made without departing from the underlying principles of the invention. Therefore, the invention should not be limited to the specific illustration and description of the preferred embodiment, but only by the following claims.

We claim:

1. A hydraulic system comprising: a charge pump having an inlet in fluid communication with a reservoir and an outlet; a charge circuit in fluid communication with the charge pump outlet and including pressure limiting means maintaining a substantially constant fluid pressure in the charge circuit; a variable displacement pump including a drive chamber in fluid communication with the charge circuit, a plurality of cylinders each having one end open to the drive chamber and a second end connected to inlet means and outlet means, a piston reciprocally mounted in each cylinder, spring means in each cylinder biasing its respective piston toward the drive chamber with a force no greater than the force exerted on the pistons by fluid pressure within the drive chamber, and drive means in the drive chamber for engaging the pistons to drive the pistons through discharge strokes; and control valve means interconnecting the charge circuit and the inlet means including varying means movable from a closed fluid blocking position through a first valving range in which it varies and controls the quantity of fluid flowing therethrough at flow rates within a first flow range and a second valving range in which it varies pressure drop of the fluid flowing therethrough at flow rates in a second flow range greater than the first range and maintains substantially constant any set pressure drop irrespective of variations in flow rates with the second flow range.

2. A hydraulic system as set forth in claim 1 further including pressure reducing means between the charge circuit and the pump drive chamber.

3. A hydraulic system for supplying controlled and variable amounts of fluid comprising: a charge pump having an inlet and an outlet with the inlet in fluid communication with a reservoir; a charge circuit in fluid communication with the charge pump outlet and including pressure limiting means maintaining a substantially constant fluid pressure in the charge circuit; a main pump including a drive chamber in fluid communication with the charge circuit, a plurality of cylinders each with one end open to the drive chamber and a second end connected to inlet means and outlet means, a piston reciprocally mounted in each cylinder and projecting into the drive chamber, spring means in each cylinder biasing its respective piston toward the drive chamber with a force no greater than the force exerted on the piston by fluid pressure within the drive chamber, and drive means in the drive chamber for engaging the ends of the pistons to drive the pistons through discharge strokes; and control valve means interconnecting the charge circuit and inlet means including a valve body having a bore therein, first and second ports provided in the valve body in communication with the bore and with the charge circuit and inlet means respectively, piston means slidably mounted in the bore for movement between fluid blocking and fluid passing positions in which it prevents fluid flow between the first and second ports and affords fluid flow between the first and second ports respectively, first and second servo means associated with the piston means responsive to fluid pressure in the first and second ports respectively for biasing the piston means toward its passing and blocking positons respectively, manually controlled plunger means projecting into and mounted in the bore for reciprocal movement, spring means compressable by a force less than the force exerted on the piston means by the first servo means acting between the piston means and plunger means to urge the piston means toward its blocking position, and abutment means carried by the plunger means for engagement with the piston means when the last mentioned spring means is compressed between the piston means and plunger means with sufficient force to vary the length of the spring means by a predetermined amount.

4. A hydraulic system as set forth in claim 3 wherein the control valve means further includes a third port provided in the valve body in communication with the second servo means when the piston means is in its fluid blocking position and blocked by the piston means when the piston means is in a fluid passing position, and means providing fluid communication between the third port and reservoir.

5. A hydraulic system as set forth in claim 3 wherein the first and second servo means are expansible pressure chambers formed by the bore in the valve body and the ends of the piston means.

6. A hydraulic system as set forth in claim 5 wherein the piston means includes a blind bore open toward the plunger means, the last mentioned spring means is a coil spring extending into and acting on the closed end of the blind bore, and the abutment means extends through the last mentioned spring means into the blind bore for engagement with the closed end of the blind bore.

7. A hydraulic system as set forth in claim 3 wherein the bore in the valve body is provided with an enlarged area intermediate its ends, the second port is in communication with enlarged area of the bore, the piston means is movable between an extreme blocking position in which it spans the enlarged area and an extreme passing position in which one end is located in the enlarged area, and the one end of the piston means is provided with metering notches.

8. A hydraulic system as set forth in claim 7 wherein the first servo means is a first expansible chamber formed by the bore and the one end of the piston means, the second servo means is a second expansible chamber formed by the bore and the second end of the piston means, the first port communicates directly with the first expansible chamber, and passage means extending through the piston means provides communication between the enlarged area of the bore and the second expansible chamber.

9. A hydraulic system as set forth in claim 8 wherein the passage means includes a blind bore provided in the piston means open to the second end of the piston means, and port means provided in the piston means providing constant communication between the blind bore and the enlarged area of the bore in the valve body.

10. A hydraulic system as set forth in claim 9 wherein the last mentioned spring means is a coil spring extending into and acting on the closed end of the blind bore, and the abutment means extends through the last mentioned spring means into the blind bore for engagement with the closed end of the blind bore.

11. A hydraulic system as set forth in claim 10 wherein the control valve means further includes a third port provided in the valve body in communication with the second servo means when the piston means is in its fluid blocking position and blocked by the piston means when the piston means is in a fluid passing position, and means providing fluid communication between the third port and reservoir.

12. A hydraulic system as set forth in claim 3 wherein the first servo means is a first expansible chamber formed by the bore and one end of the piston means, the first port communicates with the first expansible chamber, the second port communicates with the bore intermediate the ends of the piston means when the piston means is in its fluid blocking position, the second servo means is a second expansible chamber formed by the bore and the second end of the piston means, and passage means formed in the piston means provides communication between the second port and the second expansible chamber.

13. A hydraulic system as set forth in claim 12 wherein the control valve means further includes a third port provided in the valve body in communication with the second servo means when the piston means is in its fluid blocking position and blocked by the piston means when the piston means is in a fluid passing position, and means providing fluid communication between the third port and reservoir.

14. A hydraulic system as set forth in claim 13 further including check valve means between the third port and reservoir affording flow to the reservoir and preventing flow from the reservoir.

15. A hydraulic system as set forth in claim 13 wherein the one end of the piston means is provided with metering notches which regulate fluid flow from the first to the second port when the piston means is moved from its blocking position through a predetermined range.

16. A hydraulic system as set forth in claim 14 wherein force exerted on the piston means by the last mentioned spring means plus the force exerted on the piston means by fluid pressure in the second expansible chamber is less than the force exerted on the piston means by fluid pressure in the first expansible chamber when the piston means is within said predetermined range.

17. A hydraulic system as set forth in claim 3 further including pressure reducing means between the charge circuit and the pump drive chamber.

18. A hydraulic system comprising: a charge pump having an inlet in fluid communication with a reservoir and an outlet; a charge circuit in fluid communication with the charge pump outlet and including pressure limiting means maintaining a substantially constant fluid pressure in the charge circuit; a variable displacement pump including a drive chamber in fluid communication with the charge circuit, a plurality of cylinders each having one end open to the drive chamber and a second end connected to inlet means and outlet means, a piston reciprocally mounted in each cylinder, spring means in each cylinder biasing its respective piston toward the drive chamber with a force no greater than the force exerted on the pistons by fluid pressure within the drive chamber, and drive means in the drive chamber for engaging the pistons to drive the pistons through discharge strokes; and control valve means interconnecting the charge circuit and the inlet means including valving means movable to any position between fully closed and fully opened positions and responsive to a predetermined pressure drop thereacross to control the quantity of fluid flowing therethrough at pressure drops greater than the predetermined pressure drop and to maintain substantially constant any set pressure drop below said predetermined pressure drop irrespective of variations in flow.

* * * * *

UNITED STATES PATENT OFFICE

CERTIFICATE OF CORRECTION

Patent No. 3,995,973 Dated 7 December 1976

Inventor(s) Curtis Phillip Ring and Raymond John Hemming

It is certified that error appears in the above-identified patent and that said Letters Patent are hereby corrected as shown below:

Column 7, line 13, change "varying" to --valving--.

Signed and Sealed this

*Twenty-ninth* Day of *November 1977*

[SEAL]

*Attest:*

RUTH C. MASON
*Attesting Officer*

LUTRELLE F. PARKER
*Acting Commissioner of Patents and Trademarks*